US011598107B2

(12) United States Patent
Peterson

(10) Patent No.: US 11,598,107 B2
(45) Date of Patent: Mar. 7, 2023

(54) PLASTIC LINER FOR COVERING A LIFT BASKET

(71) Applicant: Tiresocks, Inc., Centennial, CO (US)

(72) Inventor: Kali Peterson, Centennial, CO (US)

(73) Assignee: Tiresocks, Inc., Centennial, CO (US)

( * ) Notice: Subject to any disclaimer, the term of this patent is extended or adjusted under 35 U.S.C. 154(b) by 607 days.

(21) Appl. No.: 16/563,849

(22) Filed: Sep. 7, 2019

(65) Prior Publication Data

US 2022/0136264 A1 May 5, 2022

(51) Int. Cl.
*E04G 5/00* (2006.01)
*E04G 5/12* (2006.01)
*E04G 1/22* (2006.01)

(52) U.S. Cl.
CPC ..... *E04G 5/002* (2013.01); *E04G 1/22* (2013.01); *E04G 5/12* (2013.01)

(58) Field of Classification Search
CPC . E04G 5/002; E04G 1/22; B66F 13/00; B66F 17/00; B66F 11/04; B44D 3/00
See application file for complete search history.

(56) References Cited

U.S. PATENT DOCUMENTS 3,406,784 A * 10/1968 Jones ..... E04H 15/001 296/10
4,765,352 A * 8/1988 Strieter ..... B08B 15/026 135/900
4,883,512 A * 11/1989 Griffis ..... B08B 15/026 55/467
5,457,922 A * 10/1995 Fara ..... E04G 21/32 52/745.15
5,558,112 A * 9/1996 Strieter ..... B09B 3/0066 135/900
5,611,410 A * 3/1997 Baillargeon ..... B66F 11/044 182/2.1
6,079,934 A * 6/2000 Beale ..... B66C 1/226 383/117
6,155,772 A * 12/2000 Beale ..... B65D 90/205 383/117
6,305,567 B1 * 10/2001 Sulpizio ..... F25D 25/025 220/8
6,383,242 B1 * 5/2002 Rogers ..... B01D 46/42 52/63
6,973,997 B2 * 12/2005 Fara ..... B08B 15/026 182/69.5
7,188,636 B1 * 3/2007 Kanne ..... E04G 21/243 135/900
7,278,677 B2 * 10/2007 Emerson ..... B60J 11/06 296/136.12
7,819,262 B1 * 10/2010 Ewan ..... B60P 7/0876 212/326

(Continued)

*Primary Examiner* — Brian D Mattei
*Assistant Examiner* — Kathleen M. McFarland
(74) *Attorney, Agent, or Firm* — Ulmer & Berne LLP; Brian E Turung

(57) ABSTRACT

A light weight plastic liner adapted for receipt over an aerial lift basket. The lift basket mounted on a wheeled boom or scissor lift. The liner includes a floor cover and four side covers for covering an inside and an outside of four sides of a frame on the lift basket. Also, the liner includes a removable door cover for covering a hinged door on the lift basket. Further, the liner includes a bungee cord in a bottom seam of the liner for holding the liner in place on the lift basket.

8 Claims, 3 Drawing Sheets

(56) References Cited

U.S. PATENT DOCUMENTS

| | | | | |
|---|---|---|---|---|
| 8,113,220 | B2 * | 2/2012 | Inglese | B28B 7/06 134/104.4 |
| 8,899,380 | B2 * | 12/2014 | Chard | B66F 17/006 182/2.1 |
| 10,024,071 | B2 * | 7/2018 | Cockerell | E04G 21/3266 |
| 10,166,686 | B1 * | 1/2019 | Dhanjal | B65B 3/003 |
| 10,442,575 | B1 * | 10/2019 | DiSpazio | B65F 1/1415 |
| 10,730,730 | B2 * | 8/2020 | Mueller | B66F 11/04 |
| 11,192,764 | B2 * | 12/2021 | Mueller | B66F 11/044 |
| 2006/0022483 | A1 * | 2/2006 | Emerson | B60J 11/06 296/136.04 |
| 2007/0158223 | A1 * | 7/2007 | Terry | A45C 7/0054 206/373 |
| 2018/0305193 | A1 * | 10/2018 | Mueller | B66F 9/065 |
| 2019/0023549 | A1 * | 1/2019 | Mueller | B66F 17/006 |
| 2019/0106309 | A1 * | 4/2019 | Mueller | B66F 11/04 |
| 2019/0177143 | A1 * | 6/2019 | Hester | B66F 11/04 |
| 2019/0203500 | A1 * | 7/2019 | LaHood | E04H 15/64 |
| 2019/0359462 | A1 * | 11/2019 | Mueller | B66F 11/04 |
| 2020/0318838 | A1 * | 10/2020 | Amundson | B65D 85/68 |
| 2021/0292147 | A1 * | 9/2021 | Mueller | B66F 11/04 |

* cited by examiner

PLASTIC LINER FOR COVERING A LIFT BASKET

BACKGROUND OF THE INVENTION

(a) Field of the Invention

This invention relates to a liner for covering an aerial lift basket and more particularly, but not by way of limitation, to a disposable plastic liner used for covering a platform floor and an inside and outside of four sides of a frame of a lift basket. The lift basket is used in painting and drywall applications.

(b) Discussion of Prior Art

Heretofore, during painting and drywall applications, using an aerial lift basket, strippable coating, tarps, paint cloths, and tape have been used to protect the lift basket from overspray. The invention eliminates the need for using the above mentioned protective items along with objects and advantages as disclosed herein.

SUMMARY OF THE INVENTION

In view of the foregoing, it is a primary objective of the subject invention to provide a light weight, plastic, disposable basket liner to cover an aerial lift basket, with open top, and protect the lift basket from paint and drywall overspray.

Another object of the invention is the plastic liner eliminates the need for using tarps, paint cloths, tape and strippable coatings, when using an aerial lift basket.

Still another object of the invention is the liner is dimensioned to cover different sizes and shapes of lift baskets. The liner covers a platform floor and an inside and outside of a frame of the lift basket. The liner also includes a removable door cover used to cover a hinged door mounted on a hinged door frame or cover an open door frame on the lift basket.

The subject invention includes a light weight plastic liner adapted for receipt over an aerial lift basket. The liner includes a floor cover and four side covers for covering an inside and an outside of four sides of a frame on the lift basket. Also, the liner includes a removable door cover for covering a hinged door or entrance opening on the lift basket. Further, the liner includes a bungee cord in a bottom seam of the four side covers for holding the liner in place on a bottom of the lift basket.

These and other objects of the present invention will become apparent to those familiar with the use of different types of lift platforms and paint and drywall applications when reviewing the following detailed description, showing novel construction and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate preferred embodiments in the present invention according to the best modes devised for a practical application of the subject disposable plastic liner, and in which.

DETAILED DESCRIPTION OF THE PREFERRED EMBODIMENTS

Figure 1:
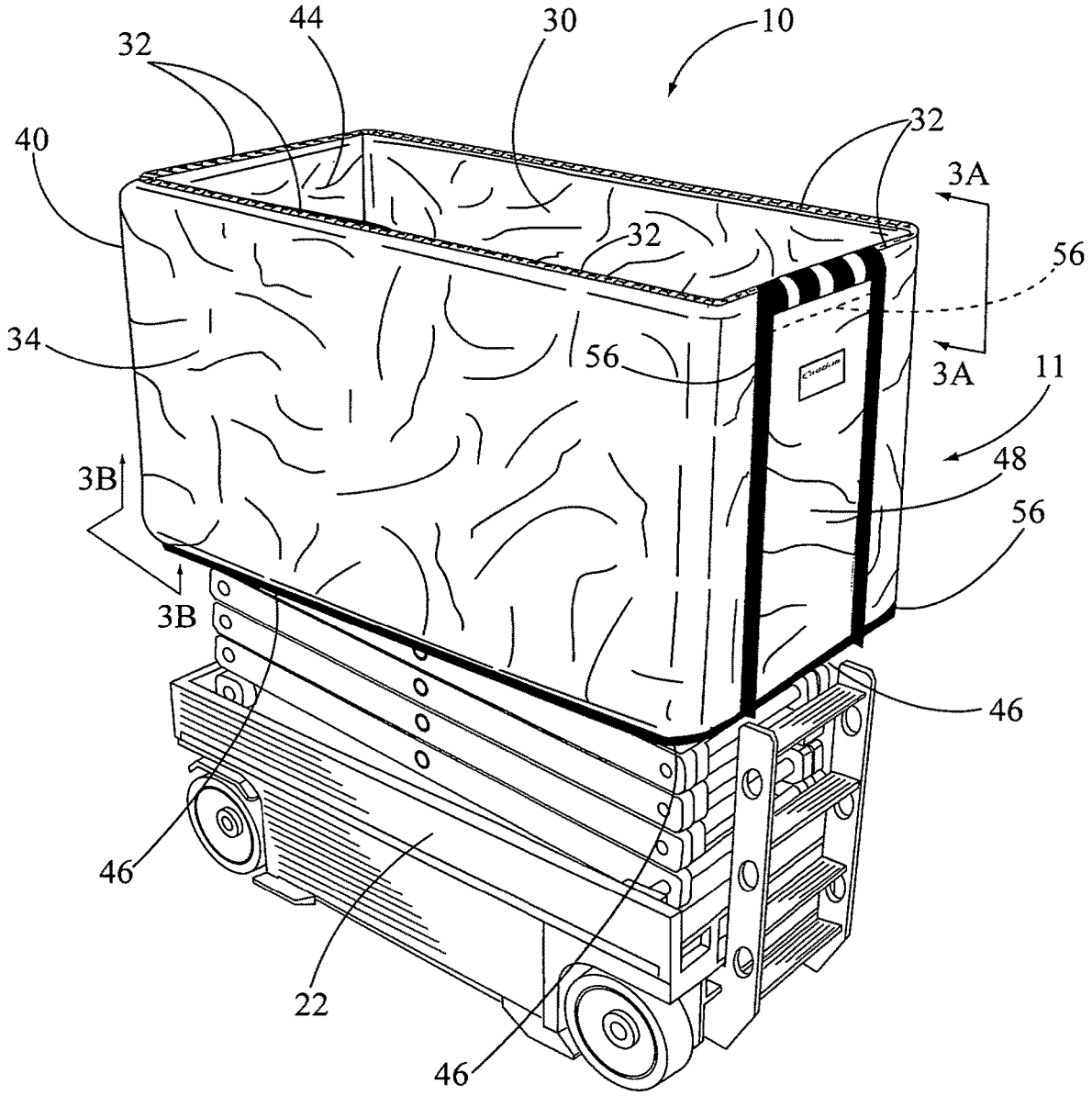
FIG. 1 is a perspective view of the disposable plastic liner shown covering a frame of a lift basket and held in place using a bungee cord disposed around a bottom of a lift basket.
Figure 2:
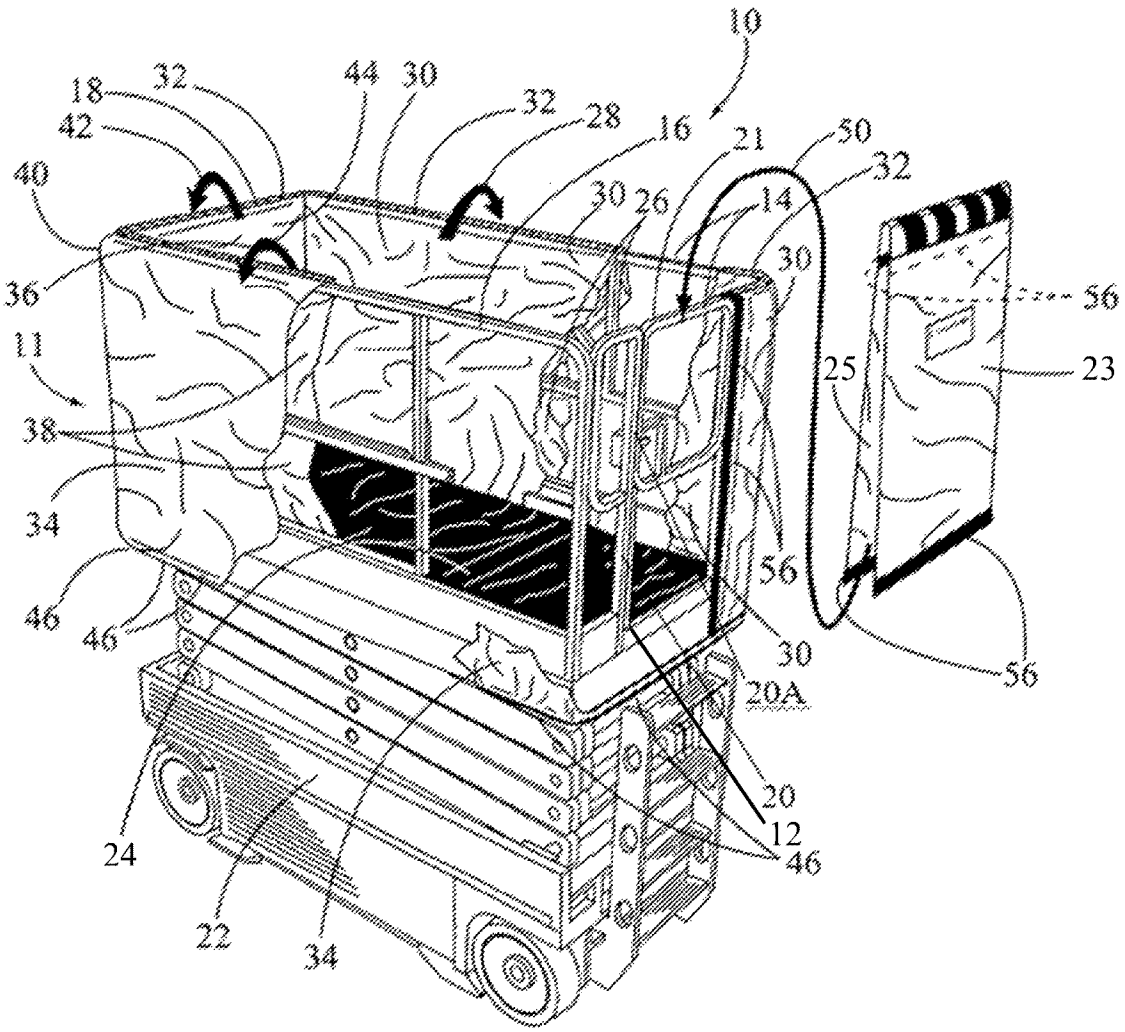
FIG. 2 is a perspective view a portion of the liner cutaway to illustrate the liner covering an inside and outside of the frame and a separate door cover for covering an inside and outside of a hinged door.

In FIGS. 1 and 2, a perspective view of the subject disposable plastic liner is shown having general reference numeral 10. As mentioned above, the liner 10 is used to cover frames of an aerial lift basket, having general reference numeral 11, from paint and drywall over spray. The aerial lift basket 11 includes an open top for an operator to stand on the lift basket for operating spray equipment.

The lift basket 11 includes a platform floor 12, a first side frame 14, a second side frame 16, a front frame 20, and a hinged entrance door frame 20A, with a hinged door 21 mounted on the hinged entrance door frame 20A. While the hinged door frame 20 and hinged door 21 are shown in the drawing, it should be kept in mind, depending on the manufacture of the lift basket 11 and a width of the platform floor, a chain or a hinged horizontal bar can be used equally well for entry into the aerial lift basket 11. Also, on smaller lift baskets 11, the basket can have an open door entrance, without a hinged door.

The frames are typically 3 to 4 feet in height. The lift basket 11 is mounted on top of a wheel mounted boom or scissor lift 22. The scissor lift 22 is used to raise and lower the platform floor 12 during the painting and drywall applications.

During the installation of the plastic liner 10, the liner is placed on top of the lift basket 11 and unfolded to cover the basket frames. A platform floor cover 24, shown in black, is first laid on top of the platform floor 12.

Next, an entrance door outside cover 23 and an entrance inside cover 25, having an entrance door opening centered thereon, are used to cover opposite sides of the hinged door frame 20, next to the hinged door 21. The door opening is not shown in the drawings.

When the lift basket 11 has a hinged door 21 that spans an entire width of the entrance, the covers 23 and 25, they would just cover the door 21. The outside cover 23 and inside cover 25 are attached to each other and are separated by the seam 32 resting on top of the hinged door frame 20. A bottom portion of the outside cover 23 includes a seam for holding a portion of a bungee cord 46.

A first side frame outside cover 26 is now unfolded and raised, as indicated by arrow 28, to cover an outside of the first side frame 14. At the same time, a first side frame inside cover 30 is used to cover the inside of the first side frame 14. The outside cover 26 and the inside cover 30 are attached to each other and are separated by a seam 32 resting on top of the first side frame 14.

As the liner 10 continues to be unfolded, a second side frame outside cover 34 is raised, as indicated by arrow 36, to cover an outside of the second side frame 16. At the same time, a second side frame inside cover 38 is used to cover the inside of the second side frame 14. The outside cover 34 and the inside cover 38 are attached to each other and are separated by the seam 32 resting on top of the second side frame 16.

Again, as the liner 10 continues to be unfolded, a front frame outside cover 40 is raised, as indicated by arrow 42, to cover an outside of the front frame 18. At the same time, a front frame inside cover 44 is used to cover the inside of the front frame 18. The outside cover 40 and the inside cover 44 are attached to each other and are separated by the seam 32 resting on top of the front frame 18.

The bottoms of the first side frame inside cover 30, the second side frame inside cover 38, the front frame inside cover 44, and the entrance door inside cover 25 are attached to the sides of the floor cover 24. The bottoms of the first side frame outside cover 26, the second side frame outside cover 34, the front frame outside cover 40, and the entrance outside cover 23 include a seam holding the bungee cord 46. The bungee cord 46 extends around the bottom of the plastic liner 10, as shown in the drawings, for holding the liner 10 in place on and around the lift basket 11.

In FIG. 2, a perspective view a portion of the liner 10 is shown cutaway to illustrate the liner covering an inside and outside of the first side frame 14, the second side frame 14, the front frame 18, and opposite sides of the hinged door frame 20.

Also shown in this drawing is a hinged door cover 48 positioned, as indicated by arrow 50, for covering a hinged door 21. The door cover 48 includes an outside cover 23 and an inside cover 25 for covering the inside and outside of the hinged door 21. A bottom portion of the outside cover 23 and the inside cover 25 includes strips of hook and loop fasteners 56 for securing the door cover 48 on the hinged door 21.

Figure 3A:
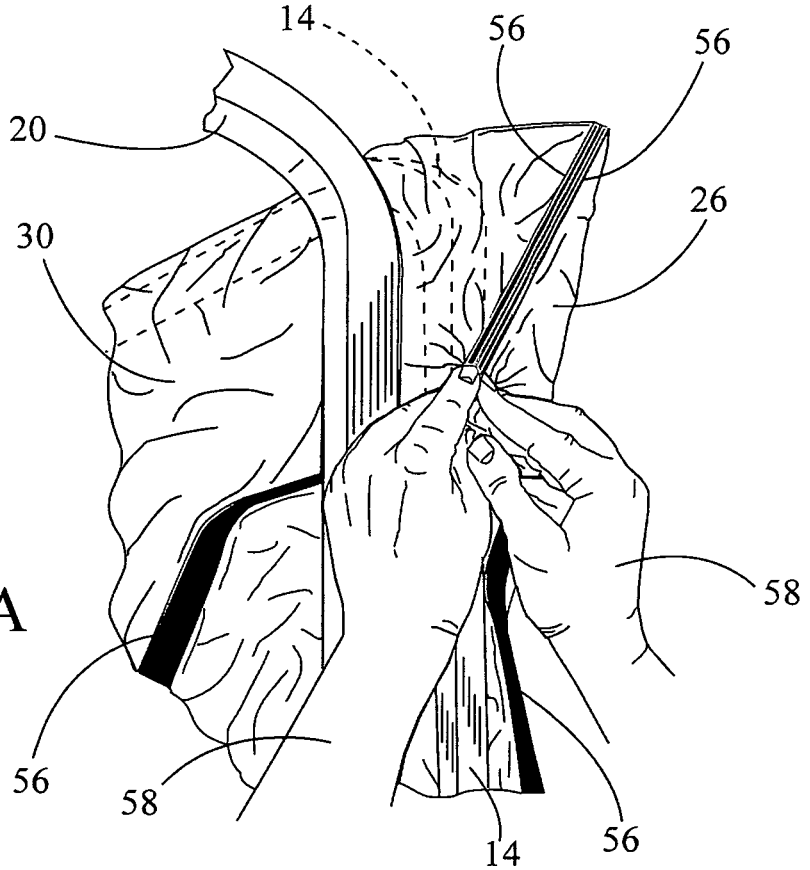
FIG. 3A is a perspective view of a portion of the liner, as shown as 3A-3A in FIG. 1, being attached to a side frame using hook and loop fasteners attached to sides of the liner.

In FIG. 3A, a perspective view of a pair of human hands 58 are shown attaching an open end of the first outside cover 26 to an open end of the first inside cover 30, using strips of the hook and loop fasteners 56. The hook and loop fasteners are used to hold the covers 26 and 30 on the first side frame 14. The hook and loop fasteners are also used to hold the second outside cover 34 and the second inside cover 38 on the second side frame 16. Also, hook and loop fasteners can be used to hold the entrance door outside cover 23 and the entrance door inside cover 25 on the sides of the hinged door frame 20, next to the hinged door 21.

Figure 3B:
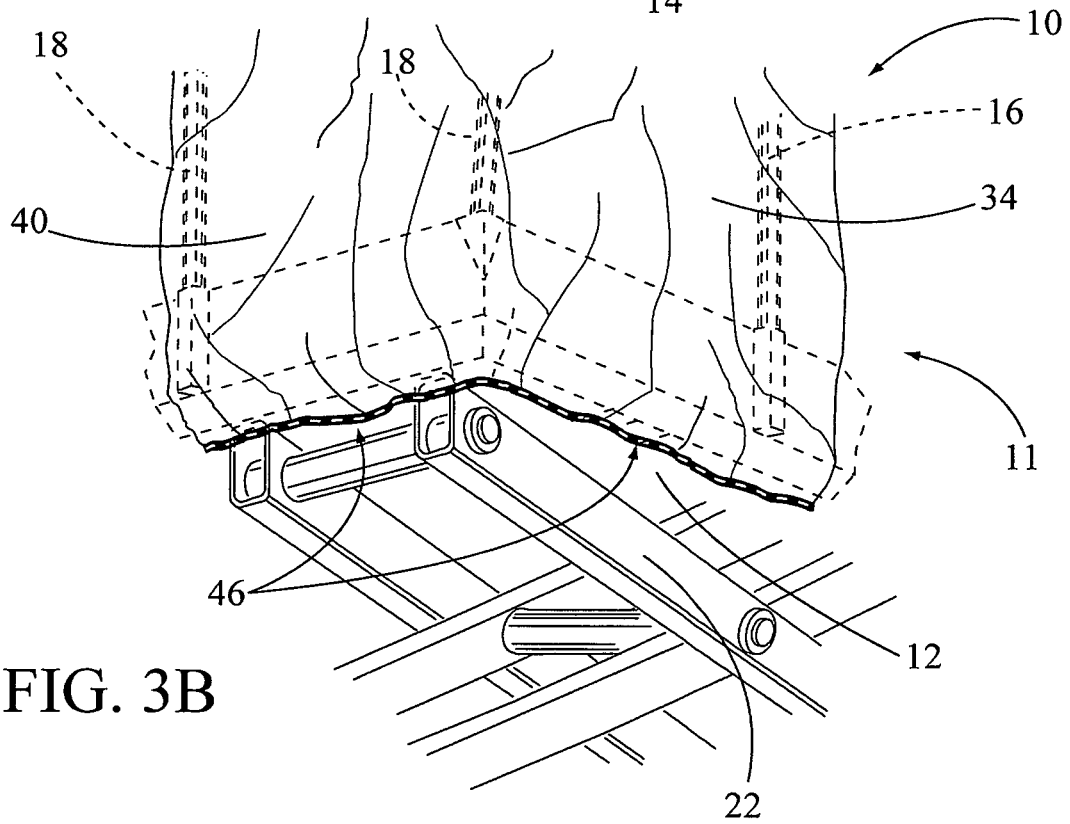
FIG. 3B is a perspective view of the liner with a bungee cord, as shown in 3B-3B in FIG. 1, in a bottom seam of the liner and used to hold the liner in place on the lift basket.

In FIG. 3B, a perspective view of the liner 10 is shown with the bungee cord 46 holding a bottom of the liner around a bottom of the lift basket 11. As mentioned above, the bungee cord 46 is used to hold the liner 10 in place on the lift basket 11. In this drawing, the second side frame 16 and the front frame 18 are shown in dashed lines and covered by the disposable plastic liner 10.

While the invention has been particularly shown, described and illustrated in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which as exclusive privilege and property right is claimed are defined as follows:

1. A light weight plastic liner configured for use on an aerial lift basket to protect said aerial lift from paint and drywall overspray and to be removably connected to said aerial lift basket; said light weight plastic liner configured to fully cover an interior of said aerial lift basket and to fully cover outer sides of said aerial lift basket when said light weight plastic liner is connected to said aerial lift basket; said light weight plastic liner comprising:

a floor cover formed of plastic sheeting that is configured to cover a top surface of a platform floor on the aerial lift basket; said floor cover having an outer peripheral edge portion;

a first inside cover and a first outside cover formed of plastic sheeting; said first inside cover including top and bottom edge portions; said first outside cover including top and bottom edge portions; said top portion of said first inside cover connected to said top portion of said first outside cover by a first seam; said bottom edge portion of said first inside cover connected to said outer peripheral edge portion of said floor cover; said bottom edge portion of said first outside cover spaced from said floor cover when said light weight plastic liner is connected to said aerial lift basket; said first inside cover configured to cover an inside of a first side frame on the aerial lift basket; said first outside cover configured to cover an outside of the first side frame on the aerial lift basket; said first seam configured to be positioned on a top surface of the first side frame when said first inside cover is covering an inside of the first side frame on the aerial lift basket and said first outside cover is covering the outside of the first side frame on the aerial lift basket; said bottom edge portion of said first outside cover including a releasable connection arrangement configured to releasably connect said bottom edge portion of said first outside cover to a bottom portion of said aerial lift basket when said light weight plastic liner is connected to said aerial lift basket;

a second inside cover and a second outside cover formed of plastic sheeting; said second inside cover including top and bottom edge portions; said second outside cover including top and bottom edge portions; said top portion of said second inside cover connected to said top portion of said second outside cover by a second seam; said bottom edge portion of said second inside cover connected to said outer peripheral edge portion of said floor cover; said bottom edge portion of said second outside cover spaced from said floor cover when said light weight plastic liner is connected to said aerial lift basket; said second inside cover configured to cover an inside of a second side frame on the aerial lift basket; said second outside cover configured to cover an outside of the second side frame on the aerial lift basket; said second seam configured to be positioned on a top surface of the second side frame when said second inside cover is covering an inside of the second side frame on the aerial lift basket and said second outside cover is covering the outside of the second side frame on the aerial lift basket; said bottom edge portion of said second outside cover including a releasable connection arrangement configured to releasably connect said bottom edge portion of said second outside cover to a bottom portion of said aerial lift basket when said light weight plastic liner is connected to said aerial lift basket;

a front inside cover and a front outside cover formed of plastic sheeting; said front inside cover including top and bottom edge portions; said front outside cover including top and bottom edge portions; said top portion of said front inside cover connected to said top portion of said front outside cover by a front seam; said bottom edge portion of said front inside cover connected to said outer peripheral edge portion of said floor cover; said bottom edge portion of said front outside cover spaced from said floor cover when said light weight plastic liner is connected to said aerial lift basket; said front inside cover configured to cover an inside of a front side frame on said aerial lift basket; said front outside cover configured to cover an outside of the front side frame on the aerial lift basket; said front seam configured to be positioned on a top surface of the front side frame when said front inside cover is covering an inside of the front side frame on the aerial lift basket and said front outside cover is covering the outside of the front side frame on the aerial lift basket; said front inside cover connected to said first inside cover and said second inside cover; said front outside cover connected to said first outside cover and said second outside cover; said bottom edge portion of said front outside cover including a releasable connection arrangement configured to releasably connect said bottom edge portion of said front outside cover to a bottom portion of said aerial lift basket when said light weight plastic liner is connected to said aerial lift basket; and, an entrance door inside cover and an entrance door outside cover formed of plastic sheeting; said entrance door inside cover including top and bottom edge portions; said entrance door outside cover including top and bottom edge portions; said bottom edge portion of each of said entrance door inside cover and said entrance door spaced from said floor cover when said light weight plastic liner is connected to said aerial lift basket; said entrance door inside cover configured to cover at least a portion of an inside of an entrance door on said aerial lift basket; said entrance door outside cover configured to cover at least a portion of an outside of said entrance door on said aerial lift basket; said entrance door inside cover and an entrance door outside cover are separate components from said floor cover, said first inside cover and said first outside cover, said second inside cover and said second outside cover, and said front inside cover and said front outside cover; said entrance door inside cover includes first and second inside door connection arrangements; said first and second inside door connection arrangements are spaced from one another; said entrance door outside cover includes first and second outside door connection arrangements; said first and second outside door connection arrangements are spaced from one another; said first inside door connection arrangement configured to releasably connect to said first outside door connection arrangement when said entrance door inside cover and an entrance door outside cover are releasably connected to said entrance door; said second inside door connection arrangement configured to releasably connect to said second outside door connection arrangement when said entrance door inside cover and an entrance door outside cover are releasably connected to said entrance door.

2. The light weight plastic liner as define in claim 1, wherein said first and second inside door connection arrangements and said first and second outside door connection arrangements are the same type of connection arrangements.

3. The light weight plastic liner as define in claim 1, wherein said first and second inside door connection arrangements are different from said releasable connection arrangement on bottom edge portion of said first outside cover, said bottom edge portion of said second outside cover, and said bottom edge portion of said front outside cover.

4. The light weight plastic liner as define in claim 2, wherein said first and second inside door connection arrangements are different from said releasable connection arrangement on bottom edge portion of said first outside cover, said bottom edge portion of said second outside cover, and said bottom edge portion of said front outside cover.

5. The light weight plastic liner as define in claim 1, wherein said first and second inside door connection arrangements include a hook and loop fastener connection.

6. The light weight plastic liner as define in claim 4, wherein said first and second inside door connection arrangements include a hook and loop fastener connection.

7. The light weight plastic liner as define in claim 1, wherein said releasable connection arrangement on bottom edge portion of said first outside cover, said bottom edge portion of said second outside cover, and said bottom edge portion of said front outside cover includes a bungee cord connection arrangement.

8. The light weight plastic liner as define in claim 6, wherein said releasable connection arrangement on bottom edge portion of said first outside cover, said bottom edge portion of said second outside cover, and said bottom edge portion of said front outside cover includes a bungee cord connection arrangement.

* * * * *